United States Patent [19]

Mathur et al.

[11] Patent Number: 4,916,909

[45] Date of Patent: Apr. 17, 1990

[54] COOL STORAGE SUPERVISORY CONTROLLER

[75] Inventors: Anoop Mathur, Shoreview; Ward J. MacArthur, Minneapolis; Steven D. Gabel, Golden Valley; Donald Taracks, Minneapolis, all of Minn.; Jianliang Zhao, Albany, Calif.; Donald H. Spethman, Northbrook, Ill.

[73] Assignee: Electric Power Research Institute, Palo Alto, Calif.

[21] Appl. No.: 291,734

[22] Filed: Dec. 29, 1988

[51] Int. Cl.[4] ..... F25D 3/00

[52] U.S. Cl. ..... 62/59; 165/18

[58] Field of Search ..... 165/18; 62/59, 185, 62/201; 364/505

[56] References Cited

U.S. PATENT DOCUMENTS

| | | | |
|---|---|---|---|
| 2,185,515 | 1/1940 | Neeson | 62/117 |
| 2,428,311 | 9/1947 | Herbener | 62/93 |
| 2,713,251 | 7/1955 | Cann et al. | 62/4 |
| 3,708,922 | 1/1973 | Clearman et al. | 62/71 |
| 3,979,059 | 9/1976 | Davis et al. | 236/46 R |
| 4,136,392 | 1/1979 | Westphal | 362/492 |
| 4,152,902 | 5/1979 | Lush | 62/157 |
| 4,266,599 | 5/1981 | Saunders | 165/2 |
| 4,292,811 | 10/1981 | Kamejima et al. | 62/56 |
| 4,294,078 | 10/1981 | MacCracken | 62/59 |
| 4,497,031 | 1/1985 | Froehling | 364/505 |
| 4,511,979 | 4/1985 | Amirante | 364/481 |
| 4,513,574 | 4/1985 | Humphreys | 62/5.9 |
| 4,537,245 | 8/1985 | Nishimura et al. | 165/22 |
| 4,565,069 | 1/1986 | MacCracken | 62/66 |
| 4,589,060 | 5/1986 | Zinsmeyer | 62/217 |
| 4,601,329 | 7/1986 | Sheridan | 165/22 |
| 4,616,325 | 10/1986 | Heckenhach | 364/505 |

FOREIGN PATENT DOCUMENTS

| | | | |
|---|---|---|---|
| 0038145 | 4/1979 | Japan | 165/18 |
| 0008645 | 1/1985 | Japan | 165/18 |
| 0134439 | 6/1987 | Japan | 165/18 |

*Primary Examiner*—William E. Wayner

*Attorney, Agent, or Firm*—Haugen and Nikolai

[57] ABSTRACT

A system for controlling the HVAC system of a building to reduce overall electrical costs is disclosed. The system develops an energy usage and storage strategy which is a function predicted ambient temperatures, predicted building load requirements and the power company's rate structure.

13 Claims, 4 Drawing Sheets

COOL STORAGE SUPERVISORY CONTROLLER

BACKGROUND OF THE INVENTION

I. Field of the Invention

This invention relates generally to heating, ventilating and air conditioning (HVAC) systems for public buildings. More specifically, it relates to a programmable device for controlling HVAC systems in a way that optimizes energy use consistent with the power company's price schedule to reduce the energy costs associated with operating the building.

In recent years, energy management in commercial buildings has become a growing concern for building owners, building tenants and electric companies alike. Building owners and tenants, troubled by rising energy costs, have looked for new ways to cut consumption. Similarly, electric companies, unsure of their ability to keep up with the rising demand, have begun to promote more sophisticated energy management systems for commercial building applications.

Many electric companies have adopted a strategy under which peak electric consumption would be shifted to non peak hours, thus, reducing peak demand. Pricing incentives have been adopted in accordance with this strategy by the suppliers of electricity. By successfully shifting consumption patterns to reduce peak demand, power companies are able to reduce their generation capacities. This, in turn, reduces the capital expenditures required of the power company for electrical generating equipment.

In order to reduce peak demand, energy companies have also actively promoted the use of cool storage systems by offering installation and rate incentives. Such cool storage systems are being installed in many new commercial buildings as well as in existing supermarkets, restaurants and office buildings. When installed in either a new or an existing building, cool storage systems operate by storing cooling energy in the form of ice or chilled water at night or during other off-peak electrical rate periods. The stored cooling energy is then used the following day during peak electrical rate periods to meet the buildings' cooling load.

Storing cooling energy at night for use during peak electric rare periods not only reduces the buildings' initial electricity demand, but also saves additional money due to the differential between off-peak and peak energy rates. Such savings, of course, vary according to the building's load profile, storage system size, control system and utility rates. The programmable device of the present invention takes these and other factors into account to optimize reductions in electricity costs.

II. Description of the Prior Art

In the past, heating and cooling of large buildings has normally been accomplished by circulating conditioned air through ventilating ducts that extend throughout the building. As discussed in U.S. Pat. No. 4,513,574 which issued on Apr. 30, 1985 to Humphries, et al. the air used to cool the building is normally supplied at about 55 degrees fahrenheit. In such systems, either the ducts or the air diffusers which discharge the conditioned air into the rooms of the building are equipped with flow control devices to permit each room to be controlled individually. While individual room control does result in lower energy consumption, such systems typically do not have the ability to store cooling energy for later use. Hence, the buildings, peak energy consumption periods typically matches the period of time during which the power company charges its highest rate.

More recently, systems have been developed which take advantage of off-peak energy rates. These systems achieve additional economies by using outside air in cool weather and cooling at night to precool the building mass. Many such systems also use ice or cold water storage for storing cooling energy. In such systems, refrigeration machines are operated at night in hot weather to precool building slabs and to make ice or chill water in storage tanks. This is done when the building is virtually unoccupied and the lights are off. Then, when cooling demand increases during the day, the pre-cooling of the building mass delays the need for peak mechanical cooling. When additional cooling is required, cold water or slush is circulated between the storage tanks and a secondary cooling coil in the air conditioning system to provide the necessary peak cooling in the afternoon. The storage in the building mass and the ice tank together work to keep the building cool during demand peaks and when the power rates are highest. The intent of such systems is to help avoid high peak demand charges by reducing electrical consumption during peak rate periods.

While cold storage systems have proven to be a reliable means for reducing total energy consumption in the building, the control units for such systems have been relatively unsophisticated. Conventional control techniques typically use a time sequence that relies on a pre-programmed chiller schedule. These controllers typically have been unable to take into account climatic fluctuations and, therefore, have only very imprecisely calculated the required storage amount to reduce electrical demand during peak periods. As a result, some days storage is completely depleted before the peak period has ended. The building must then rely on its chiller for direct cooling, resulting in high demand charges. Conversely, on days when the cooling load is low, storage is not effectively utilized since the chiller comes on according to a preprogrammed schedule. As a result, the system builds up too much ice in storage. This ice simply goes to waste. In either event, the building's electric bill is needlessly increased.

SUMMARY OF THE INVENTION

The control system of the present invention may be used in conjunction with most energy management systems. For example, it is particularly well suited for the system offered by Honeywell's commercial building group under the trademark EXCELMICRO CENTRAL. These commercial products have successfully been used to control the chiller, pump, storage, and air handling units of commercial buildings. When equipped with the present invention, utilization of such cooling systems is optimized from an energy conservation standpoint.

The present invention stores the daily ambient temperature and building load profiles in history files. At the end of a daily cooling cycle the user inputs a national weather service forecast of high and low ambient temperatures for the next day. Temperature prediction algorithms use the forecasted temperatures and the historical temperature profile to predict an ambient temperature profile for the following day.

The temperature prediction algorithms are used to update the temperature profile each hour by comparing the actual measurements with the predicted values for the temperature profile. For example, the temperature prediction algorithms will update the forecasted high and low temperatures after just a few actual measurements of the ambient temperature. Thus, the values input daily by the user are just initial estimates for high and low temperatures. If a new forecast is not input, the previous days' forecast will be used.

In addition to the temperature prediction algorithms, the present invention includes load prediction algorithms which are used to predict the building's cooling load profile for the following day. The load prediction algorithms use historical load data and the temperature data to construct a parametric mathematical model for the building. The predicted load profile can be adjusted for holiday schedules, partial building occupancy schedules and for additional loads required on days after holidays and weekends.

The present invention also incorporates energy management strategy algorithms. These algorithms, in conjunction to the ambient temperature profile and the cooling load profile, compare the cost of direct chiller cooling with the cost of cold storage cooling. These algorithms then select the least expensive option. The strategy algorithms are sufficiently sophisticated to consider the amount of storage available, equipment limitations, the predicted load profile and the building's non-cooling energy load profile to plan the optimum storage charge and storage discharge cycle strategies.

Specifically, the strategy algorithms are used to plan the amount of storage to charge and a usage profile for storage. If costs justify, or if the integrated load is larger than the available storage, the strategy algorithms plan the use of direct chiller cooling. In planning direct chiller cooling, the algorithms first search for valleys in the buildings' non-cooling load profile and schedule direct chiller use for those times. Storage is saved for cooling during peak periods in the non-cooling load profile or during the power company's peak charge period. If necessary, the algorithms incrementally increase the building demand curve until the entire predicted load is met. In multiple demand rate periods (such as semi-peak and peak periods), the strategy algorithms trade off between the demand for the two periods.

An important advantage of the present invention is that it can be tailored with user input flags to be used with many different cooling plants, building configurations and utility rate structures. The device quickly "learns" the building load profiles starting with no information on the building. After a few days of measured cooling load and temperature profile data, the algorithms will have learned the buildings' parametric model.

The principle object of the present invention is to provide a controller which optimizes the use of stored energy under all load conditions and for various design configurations to reduce electrical costs. Other objects of the present invention include providing a controller which (a) ensures full use of storage during low load days;

(b) determines the best schedule for chiller use by ensuring that enough storage is available to meet the load toward the end of the peak period;

(c) adapts to different utility rate structures;

(d) adapts to different cooling plant configuration;

(e) adapts to chilled water storage, ice storage or eutectic salt storage system characteristics;

(f) determines whether storage should be used only in demand periods or if there are benefits to using storage in other periods as well;

(g) if necessary, uses the valleys in the building's electrical profile to provide direct cooling to reduce the building's total demand for electricity;

(h) chooses the times and conditions when it is most cost efficient to operate the chiller; and (i) provides significant energy cost savings.

DETAILED DESCRIPTION OF THE PREFERRED EMBODIMENT

Figure 1:
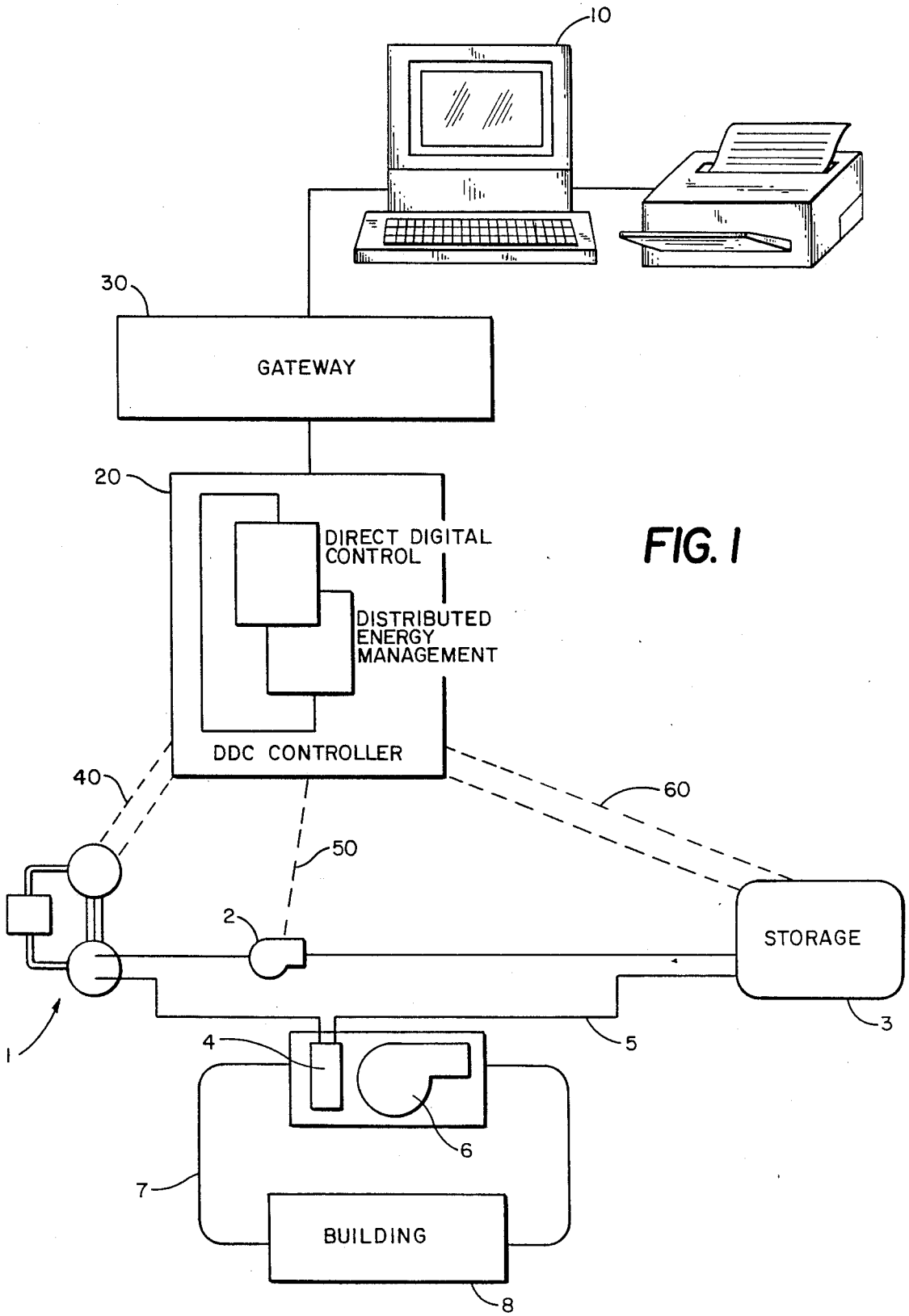
FIG. 1 is a diagram showing the controller of the present invention attached to a typical cool storage HVAC system.

FIG. 1 shows a conventional HVAC system which has been modified to be controlled by the control system of the present invention. As shown, the HVAC system includes a chiller 1; a pump 2; an ice storage unit 3; a heat exchanger 4; and a chilled water loop 5 connecting said chiller, pump, ice storage unit and heat exchanger. The basic operation is that the pump 2 circulates chilled water through the chilled water loop 5 to a heat exchanger 4 in the HVAC unit. Conventional blowers 6 are then used to circulate air through the heat exchanger 4 to cool the air and then through the various HVAC 7 ducts in the building 8.

The hardware comprising the controller system of the present invention includes a computer 10, a direct digital controller 20, a gateway 30 between the computer and the direct digital controller, and separate two-way communication interfaces 40, 50 and 60 between the controller 20 and the chiller 1, pump 2 and storage unit 3. The inventors have specifically design the algorithms associated with the present invention to be run on a Honeywell Micro Central Personal Computer with concurrent DOS. However, the software which includes these algorithms can easily be rewritten to accommodate other computers. The computer 10 should, however, have an Intel 8088, 80286, 80386 or comparable microprocessor 11. The computer should be equipped with sufficient Random Access Memory 12, a hard drive 13 or other suitable storage media, a keyboard 14 for data entry, a display 15, and a printer 16 for making hard copies of reports. Also, without deviating from the invention, the software can be rewritten to accommodate substitute direct digital controllers, gateways and interfaces.

While the inventors believe that the Excel Plus Direct Digital Controller sold by Honeywell Inc. is ideal for all applications associated with the present invention, those skilled in the art will recognize that other direct digital control distributed energy management systems will work. In the preferred embodiment, the Excel Plus DDC Controller is attached to a Honeywell Micro Central Personal Computer through Honeywell's proprietary Excel Plus gateway. In the preferred embodiment, the algorithms are stored and run on the computer 10. However, those skilled in the art will recognize that the separate computer 10 could be eliminated by placing comparable processing, storage, memory, input and display capabilities in the direct digital controller 20.

As set forth above, conventional commercial building HVAC systems typically employ cooling plants having sufficient cooling capacity to directly meet the peak instantaneous cooling load. The strong influence of weather conditions and the day time occupancy schedules of commercial buildings produce a pronounced daily peak in electric demand placed on electric utilities. This condition has persisted for many years and contributes to a continuing need for utilities to add new generating capacity. Due to the ever increasing costs and lead times required to add new generating capacity, utilities have modified their rate structures to encourage the installation of cool storage systems as a means for helping balance their load factors and for reducing the need for new generating capacity.

The essential purpose of the controller 20, gateway 30, personal computer 10 and interfaces 40, 50 and 60 shown in FIG. 1 is to optimally control cold storage by a strategy that manages the charging and discharging of ice storage to meet energy load requirements at minimum cost. This strategy depends upon prediction of temperatures and loads and the comparison of alternative costs due to energy and demand charges plus losses and inefficiencies. This is all accomplished using the software developed for the present invention.

While there are a variety of cool storage designs with unique characteristics that establish cost factors and operating limits, the hardware and software of the cool storage supervisory controller of the present invention accommodates the major types of designs with application selection and design parameters where appropriate. The present invention provides real time supervisory control to the local control of a chiller and a storage system. The interfaces to the system permit direct input measured values and output control commands.

Figure 3:
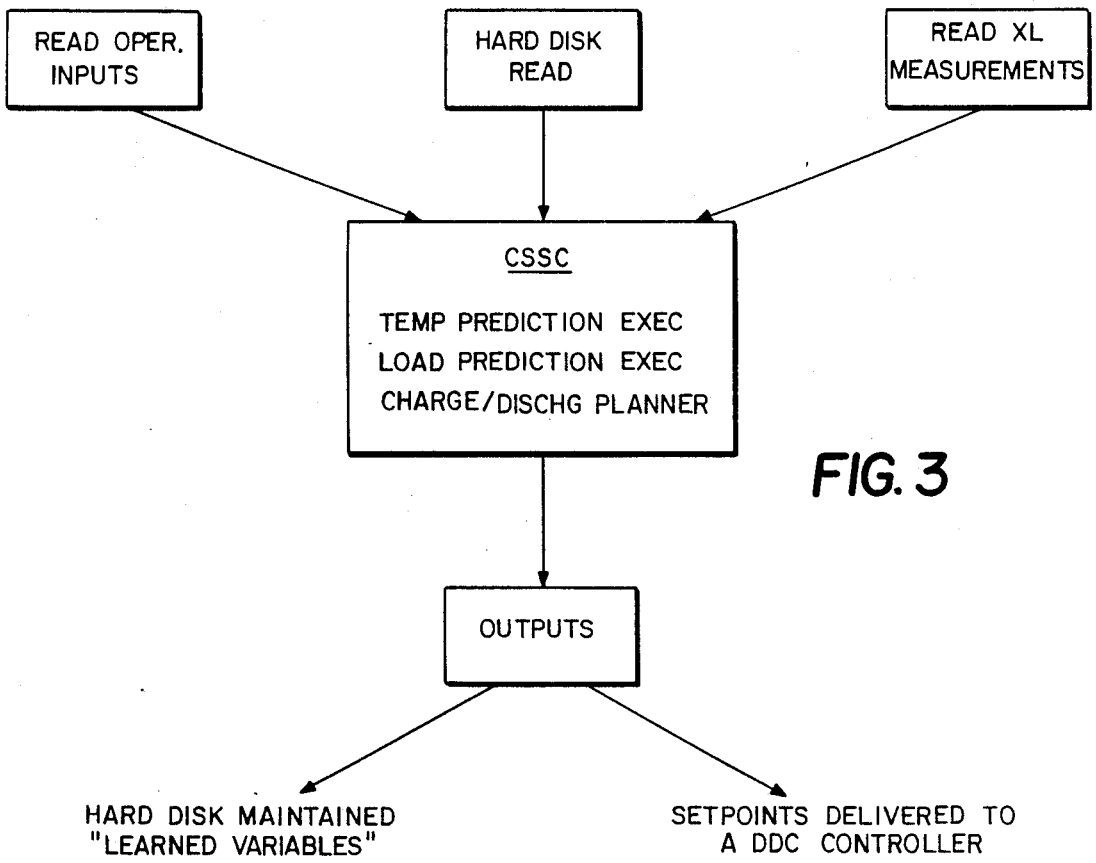
FIG. 3 is a block diagram showing the types of inputs to and the types of outputs generated by the central system of the present invention.
Figure 2:
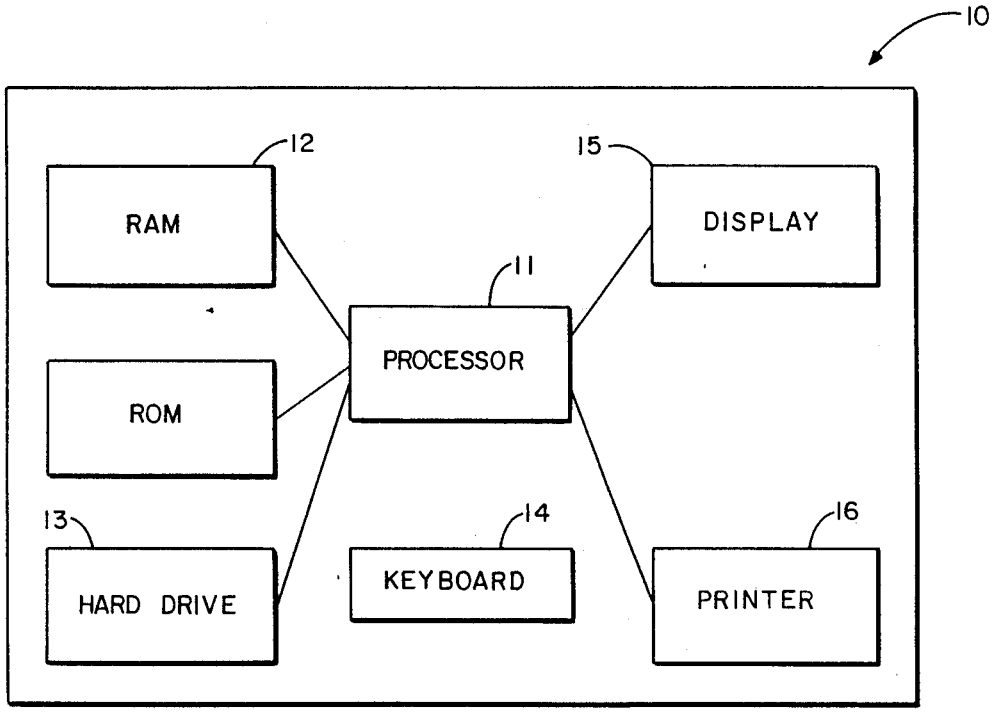
FIG. 2 is a block diagram of the computer used in the present invention.
Figure 4A:
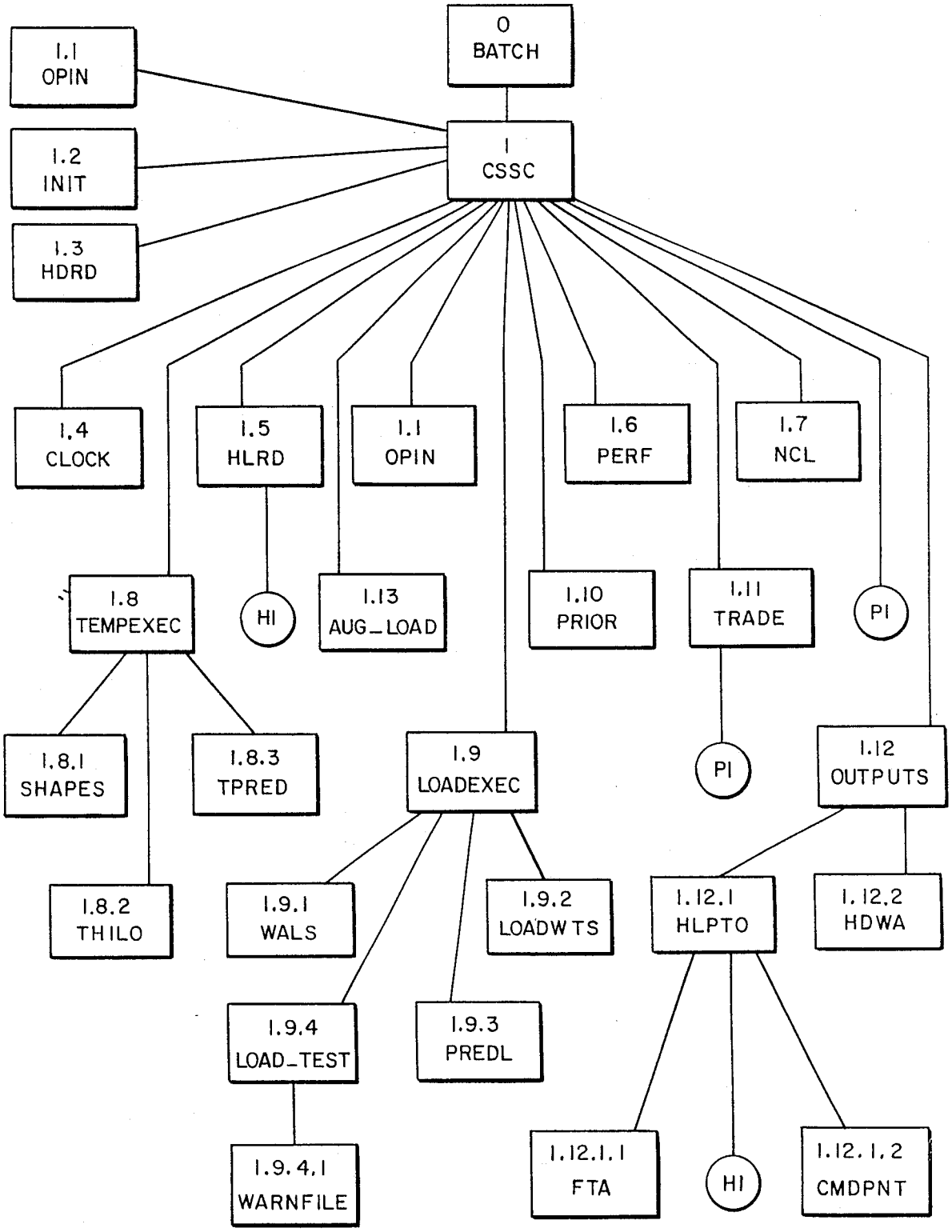
FIGS. 4A, 4B, 4C and 4D are flow chart showing the interrelationship between the HIPO diagrams of the system software.
Figure 4B:
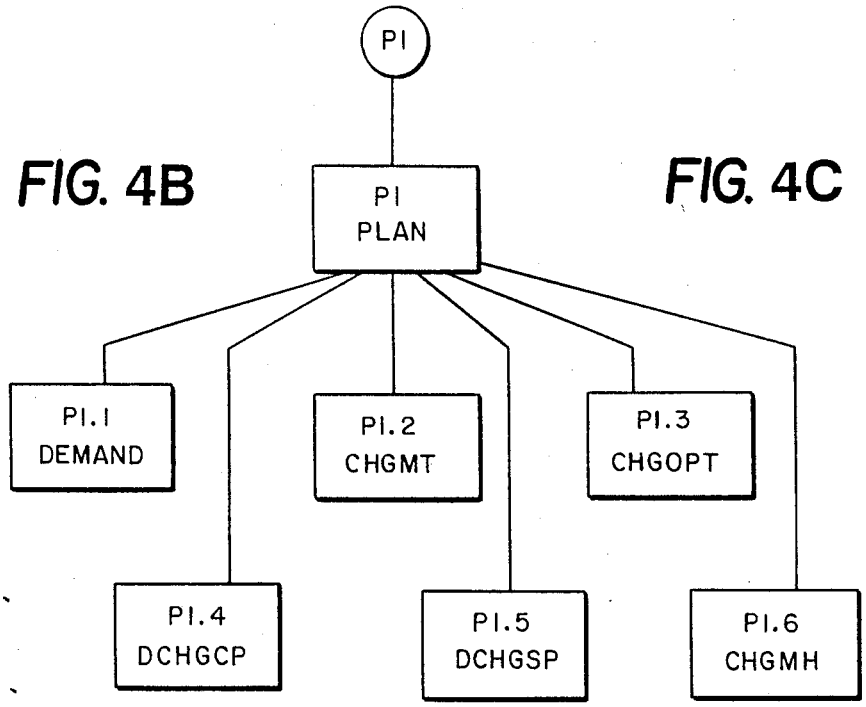
Figure 4C:
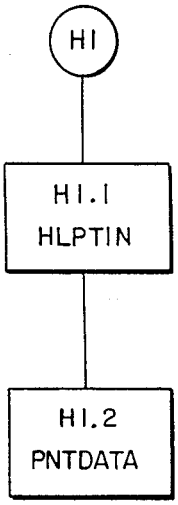
Figure 4D:
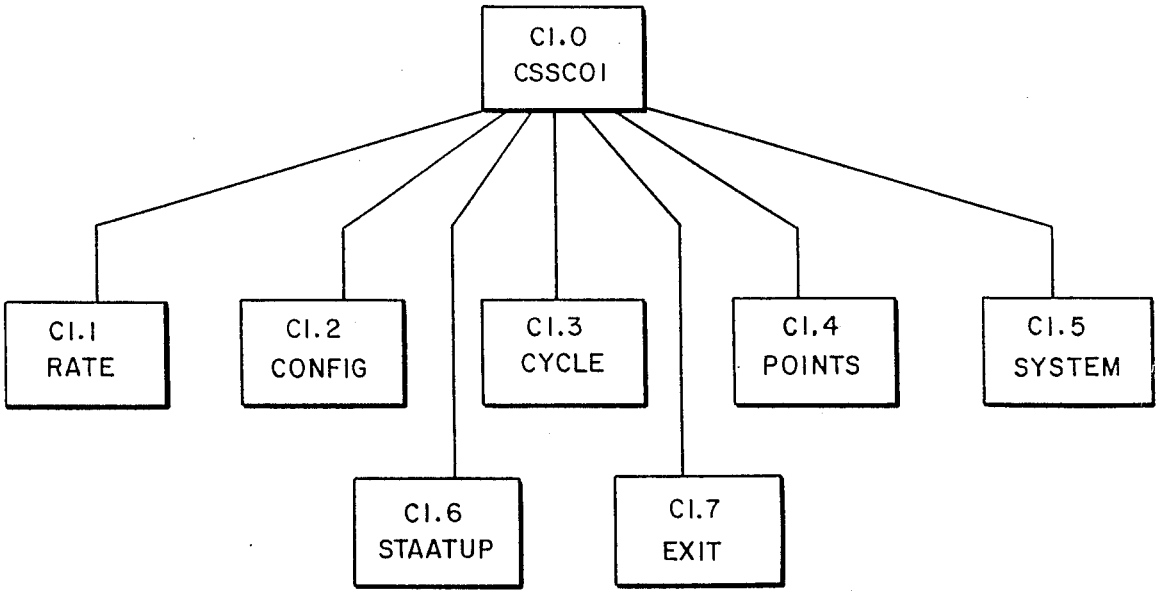

FIG. 3 is intended to show in block diagram form, the various types of inputs to the CSSC system and the various outputs generated by the software of the CSSC system based upon these inputs. As indicated in FIG. 3, the inputs accepted by the CSSC include "Read Oper. Inputs", "Hard Disk Read" and "Read XL Measurements". "Read Oper. Inputs" may include data supplied by the operator such as rate structure, site specific configurations, utilization schedules, DDC point addresses and startup values. "Hard Disk Read" may include hard disk maintained learned variables such as historical temperatures, historical loads, covariance matrix data, regressor vector data, theta values, etc. "Read XL Measurements" may include measurements from a DDC controller including current temperature, building load, cooling load, demand limit, chiller rate, mode of operation and inventory level, for example. "OUTPUTS" as indicated in FIG. 3 include hard disk maintained learned variables as listed above and setpoints delivered to a DDC controller such as chiller setpoints, demand limit, change mode and storage fill level.

A more detailed representation of these inputs and outputs generated after processing with the software is provided from a review of the HIPO diagrams appended hereto.

A narrative description of the operation of the preferred embodiment will now be provided.

The main routine of the software interrogates the system for 10 required inputs at 5 minutes past the beginning of each hour. The 10 required inputs are:

(1) TACTC (Average Ambient Temperature for Previous Hour);
(2) COOLC (Cooling Load in Ton H for Previous Hour);
(3) BLDKW (Building Kilowatt Hour Usage for Previous Hour);
(4) KWH2 (Chiller Kilowatt Hour Usage for Previous Hour);
(5) DLPA (Actual Demand Limit);
(6) QCHILL (Chiller Cooling for Previous Hour);
(7) ICHG (Current Mode—Chiller or Storage);
(8) SIW (Inventory Storage Level—Percentage Full);
(9) TPREDLO (Tomorrow's Predicted Load Temperature); and
(10) TPREDHI (Tomorrow's Predicted High Temperature).

Some of the inputs identified above are user defined, while others are automatically determined. The operator interface (i.e., the display screens) of the present invention provides a user friendly environment for site specific data entry using a numeric selection menuing system. Copies of the display screens are included as Tables IXI herein below. The user first selects the category of interest, i.e. utility rate structures, configuration parameters, cycle definitions, etc. from the main menu. See Tables I. The user is then presented with current values for all data within that category and is prompted to modify the data or return to the main menu. If the user chooses to modify, the selected sub-menu is presented. The user may modify individual items or change all items within the category. After making the desired changes, the user is presented the revised values for all data within the category and is prompted to "save and return to main menu" or "return without saving" the changes. The CSSC algorithms will incorporate any changes to the site specific parameters at the start of the next hour upon system reboot.

The software of the present invention allows the user to define a variety of utility rates scenarios from the utility rate structure submenu. This includes setting the number of rate periods (1–3), the demand charge for each period, the energy charge for each period, and time block definitions. A time block is defined as a continuing period of time beginning at 0 minutes after the beginning hour and ending 59 minutes after the ending hour, during which the demand charge and the energy charge remain constant. The number of time blocks is determined from the number of rate periods as follows:

$$\text{number of time blocks} = (2 \times \text{number of rate periods}) - 1.$$

Upon entering the utility rate structure submenu, the operator is presented with a chart detailing the current rate structure definitions. See Table II. This chart includes, for each time block, the rate type (peak, semi-peak, or off-peak); start and stop times, demand charge and energy charge. If the user chooses to modify the rate structure definitions, the following must be entered: (1) number of rate periods; (2) energy and demand cost for each rate period; (3) start and stop times for each time block; and (4) a rate period/time block relationship. The user is responsible for ensuring that the time blocks span the period from 0:00-23.59. The operator is then presented with a modified rate structure and prompted to either save the modified rate structure definition and return to the main menu or return without saving.

The CSSC software includes the following rate structure related routines:

(1) RSP (Energy Charge Array);
(2) RD (Period Demand Charge Array); and
(3) IP (Hour-to-Period Type Mapping Array).

In addition to rate structures, site configuration information is important for the system to work efficiently. Such information is provided using the site configuration submenu. See Tables III and VII. This menu is used to set rate limits, safety factors and coefficients of performance (COP). The user is required to define the following:

(1) DRL (Discharge Rate Limit—Tons);
(2) CRL (Chiller Rate Limits—Tons);
(3) SCL (Storage Capacity Limit—Ton Hours);
(4) SSF (Storage Safety Factor);
(5) PSF (Prediction Safety Factor);
(6) IPENALTY (Storage Type—Penalty for Incomplete Charge or No Penalty for Incomplete Charge);
(7) COPDIR (Initial Nominal Direct Chiller COP Value); and
(8) COPCHG (Initial Nominal Charge Chiller COP Value).

The storage safety factor is the minimum fraction of the storage capacity limit to be maintained in storage to act as a safety buffer when actual load deviates significantly from the predicted load. The prediction safety factor is the prediction by which the predicted building cooling load will be increased. The COPDIR and COPCHG factors are initial coefficients of performance as described by the following equation:

$$COP=(QCHILL/CHILLER\ kW\ Usage \times 3.517\ kwH/tonH).$$

The CSSC software updates these factors by using a 90/10 moving average with reasonableness checks.

Operating periods for the chiller system and utilization factors are defined using the cycle definitions and utilization submenu. See Tables IV and VIII. The utilization factor is a percent of normal full operation anticipated on a weekly basis. These factors may be updated for holidays, extra shifts, and other scheduled events that impact building utilization. Variables that apply to cycle and utilization definitions include:

(1) ISTART [DAY]: (Hour 0-23 during which the chiller is turned on);
(2) ISTOP [DAY]: (Hour 0-23 during which the chiller is turned off); and
(3) PCT [DAY]: (Fraction 0.0-1.0 of normal building utilization).

Since the CSSC software of the present invention is designed to be tailored to any of a variety of direct digital controllers and their associated communications interfacing techniques, the software includes a sensor addressing submenu. The user is prompted, by sensor name, to enter the sensor address for all fourteen of the required inputs and outputs. See Table IX. If the Honeywell Delta Net/Excel Plus system is being used, this requires a logical group/point pair that references a physical or logical point within the controllers domain.

System definitions are provided using the system definition submenu. See Tables and X. This submenu is specifically designed to define the chiller system using three flags and the peak design load value. Values that must be input include:

(1) IPAL (Parallel or Series ?);
(2) IEQ (Peak Demand Cost Equal Off-Peak Cost—True or False ?);
(3) IPENALTY (Penalty for Partial Discharge—Yes or No?); and
(4) DESL (Peak Design Load).

The final set of user inputs are provided using the startup submenu. See Tables VI and XI. The adaptive techniques used by the CSSC software have a "learning curve" that can be significantly compressed if typical temperature, load, and non-cooling load profiles are supplied for the time of startup. This data is used for initial startup, modifications to the physical chiller system, or any system failures. This data can be periodically reviewed and changed if necessary to reflect seasonal adjustment or trends. The following four profiles are entered through the startup submenu:

(1) TEMP (Hourly Temperature Profile);
(2) LOAD (Hourly Load Profile);
(3) FACT (Hourly Temperature Shape Factors);
(4) NCLD (Hourly Non-Cooling Load Profile); and Tables I-XI hereinbelow represent the screens of the operator interface of the present invention.

TABLE I

| CSSC MAIN MENU |
|---|
| [1] Utility Rate Structure |
| [2] Configuration Parameters |
| [3] Cycle Definitions and Utilization Factors |
| [4] Group and Point Numbers for Excel Interface |
| [5] System Definitions |
| [6] Startup Values |
| [0] Return to Microcentral Menu |
| Please Enter Your Numeric Choice [ ] |

TABLE II

The current rates are as follows:

| Period | Start | Stop | $/kW | $/kWH |
|---|---|---|---|---|
| Off-Peak | 0:00 | 7:59 | 4.25 | 0.0330 |
| Peak | 8:00 | 17:59 | 4.75 | 0.0410 |
| Off-Peak | 18:00 | 23:59 | 4.25 | 0.0330 |

Would you like to make changes? (1 = yes 0 = no) —

TABLE III

| CONFIGURATION MENU |
|---|
| [1] Update All Configuration Parameters |
| [2] Enter Discharge Rate Limit |
| [3] Enter Chiller Rate Limit |
| [4] Enter Storage Capacity Limit |
| [5] Enter Storage Safety Factor |
| [6] Enter Prediction Safety Factor |
| [7] Enter Storage Type |
| [8] Enter Nominal Direct Chiller COP Value |
| [9] Enter Nominal Charge Chiller COP Value |
| [0] Return to CSSC Main Menu |
| Please Enter Your Numeric Menu Selection [ ] |

TABLE IV

| CYCLE AND UTILIZATION DEFINITION MENU |
|---|
| [1] Update all Cycle and Utilization Parameters |
| [2] Change Daily Start and Stop Times |
| [3] Change Daily Percent Utilization |
| [4] Change IENDP |
| ]4] Return to CSSC Main Menu |

TABLE IV-continued

| CYCLE AND UTILIZATION DEFINITION MENU |
|---|
| Please Enter Your Numeric Menu Selection [ ] |

TABLE V

| SYSTEM DEFINITIONS MENU |
|---|
| [1] Update All System Settings |
| [2] System Type |
| [3] Demand Charge Type |
| [4] Storage Type |
| [5] Peak Design Load |
| [0] Return to CSSC Main Menu |
| Please Enter Your Numeric Menu Selection [ ] |

TABLE VI

| CSSC SYSTEM STARTUP VALUES MENU |
|---|
| [1] Update all Configuration Parameters |
| [2] Startup Temperature Values |
| [3] Startup Load Values |
| [4] Startup Daily Temperature Profile |
| [5] Startup Non-Cooling Load Values |
| [0] Return to CSSC Main Menu |
| Please Enter Your Numeric Menu Selection [ ] |

TABLE VII

| The Current Configuration is as Follows: | |
|---|---|
| Discharge Rate Limit | 45.0 |
| Chiller Rate Limit | 45.0 |
| Storage Capacity Limit | 400.0 |
| Storage Safety Factor | 0.0 |
| Prediction Safety Factor | 0.0 |
| Storage Type | * |
| Nominal Direct Chiller COP Value | 2.50 |
| Nominal Direct Chiller COP Value | 2.50 |
| *Penalty for Partial Discharge | |
| Would You Like to Make Changes? (1 = yes 0 = no) — | |

TABLE VIII

The Current Utilization Definitions are as Folloew:

| Day | Start | Stop | Percent |
|---|---|---|---|
| Sunday | 6:00 | 17:59 | 0.00 |
| Monday | 6:00 | 17:59 | 1.00 |
| Tuesday | 6:00 | 17:59 | 1.00 |
| Wednesday | 6:00 | 17:59 | 1.00 |
| Thursday | 6:00 | 17:59 | 1.00 |
| Firday | 6:00 | 17:59 | 1.00 |
| Saturday | 6:00 | 17:59 | 0.00 |

Would You Like to Make Changes? (1 = yes 0 = no) —

TABLE IX

The Current Excel Group and Point Values Are:

| Name | Group | Point |
|---|---|---|
| Ambitemp | 1 | 24 |
| Build_kW | 1 | 23 |
| Chill_kW | 1 | 21 |
| Stor_inv | 2 | 21 |
| Coolload | 1 | 13 |
| Ichg | 3 | 1 |
| Chl_clrt | 1 | 19 |
| Dlp_act | 1 | 27 |
| Tomor_hi | 3 | 17 |
| Tomor_lo | 3 | 18 |
| Fill_lvl | 3 | 23 |
| Iprior | 2 | 12 |
| kWset_pt | 2 | 11 |
| Dlp | 2 | 9 |

Would You Like to Make Changes? (1 = yes 0 = no) —

TABLE X

| The Current Configuration is as Follows: | |
|---|---|
| System type | Series |
| Demand Charge Type | Peak and Off-Peak Demand Charges are Equal |
| Storage Type | No Penalty for Partial Discharge |
| Peak Design Load (Tons) | 80.0 |
| Would You Like to Make Changes? (1 = yes 0 = no) — | |

TABLE XI

The Current CSSC System Startup Values Are:

| Hour | 0 | 1 | 2 | 3 | 4 | 5 | 6 | 7 |
|---|---|---|---|---|---|---|---|---|
| TEMP | 60 | 59 | 59 | 58 | 57 | 56 | 53 | 52 |
| LOAD | 0.0 | 0.0 | 0.0 | 0.0 | 0.0 | 0.0 | 0.0 | 0.0 |
| FACT | 0.40 | 0.35 | 0.35 | 0.30 | 0.25 | 0.20 | 0.05 | 0.00 |
| NCLD | 3 | 3 | 3 | 3 | 3 | 3 | 9 | 11 |
| Hour | 8 | 9 | 10 | 11 | 12 | 13 | 14 | 15 |
| TEMP | 54 | 56 | 59 | 63 | 67 | 69 | 69 | 70 |
| LOAD | 20.0 | 17.0 | 20.0 | 21.0 | 21.0 | 21.0 | 23.0 | 21.0 |
| FACT | 0.10 | 0.20 | 0.35 | 0.55 | 0.75 | 0.85 | 0.85 | 0.90 |
| NCLD | 13 | 14 | 14 | 14 | 14 | 14 | 14 | 13 |
| Hour | 16 | 17 | 18 | 19 | 20 | 21 | 22 | 23 |
| TEMP | 71 | 72 | 71 | 71 | 69 | 68 | 67 | 66 |
| LOAD | 24.0 | 23.0 | 21.0 | 0.0 | 0.0 | 0.0 | 0.0 | 0.0 |
| FACT | 0.95 | 1.00 | 0.95 | 0.95 | 0.85 | 0.80 | 0.75 | 0.70 |
| NCLD | 13 | 13 | 10 | 7 | 4 | 4 | 4 | 3 |

Would You Like to Make Changes? (1 = yes 0 = no) — —

The CSSC system of the present invention provides necessary control instructions for the storage charge or discharge modes of the cooling system of the particular building in which it is installed. It also provides the appropriate modulating capacity control of chiller and storage to meet system needs. This is done using the DDC program. The DDC program is executed every few seconds to give responsive closed loop control. In a normal application, the CSSC program will establish the start and stop of the charge period. The DDC program then controls charging until the required inventory is reached.

The DDC control program utilizes three types of inputs. These are hardware sensor inputs, values from the CSSC, and adjustable tuning parameters. Hardware sensor inputs include: (a) chilled water supply temperature, (b) chiller kwH, (c) building kwH, (d) chiller compressor status, and (e) charge mode status. Values received from the CSSC include:

(1) Discharge Mode Supply Set Point;
(2) Charge Mode Supply Set Point;
(3) Chiller Current Limit Set Point;
(4) Building Current Limit Set Point;
(5) Charge Mode Status; and
(6) Desired Inventory Charge Level.

Adjustable parameter values include: (1) low sequence (chiller control) start; (2) low sequence end; (3) high sequence (storage control) start; (4) High sequence end; (5) current PID proportional gain; (6) current PID integral time; (7) current PID derivative time; (8) chilled water PID proportional gain; (9) chilled water PID integral time; and (10) chilled water PID derivative time. Other adjustable parameters that must be set include four chiller stage on/off settings as well as the current sequence start and stop settings.

In response to the inputs set forth above, the DDC control program generates certain outputs. These outputs are either real hardware points that are controlled or else software only (pseudo) points that show calculated intermediate results. Control hardware points include discharge storage valve, chiller stage 1 on/off, chiller stage 2 on/off, chiller stage 3 on/off, and chiller stage 4 on/off. The calculated result pseudo points include: chilled water supply control signal, current limit control signal, chiller temperature control, chiller capacity limit control and maximum current error signal.

The control sequence of the DDC program will now be described. During the storage discharge mode, the chilled water supply temperature controller increases stages of chiller capacity subject to current limits set by the CSSC and then gradually opens the discharge storage valve as necessary to maintain the required discharge temperature. Current limits set by the CSSC are the building KWH and when on storage priority the chiller KWH which is reset by the CSSC as necessary to force the use of storage. When on chiller priority, only the building KWH limit reduces chiller operation causing the use of storage to maintain the demand limit on the building.

During the storage charge mode, the system load is bypassed and all chiller flow is routed through storage at a low temperature to make ice or chill water in storage. In the normal situation, the charge mode status and the planned inventory charge level established by the CSSC are sent to the direct digital controller. The direct digital controller then implements charging until the planned inventory level was reached. Of course, the direct digital controllers other than the Honeywell Excel Plan may require different DDC control sequences. However, the signals from CSSC and the basic sequence of control remain the same.

The DDC program includes computer algorithms which will perform energy calculations and provides hourly values to the CSSC as follows: cooling load in ton-hours, chiller input in KWH, chiller output in ton-hours, building demand as KW High, Outside air dry bulb average temperature, storage inventory and percentage. This program is specifically designed to integrate time with power to give the energy used each hour. In certain configurations, multiple sensors are used in delivering inventory. When multiple sensors are used, the proper calculation of total inventory is made and the result is a software only "pseudo" point to be read and used by the CSSC program.

Now that the DDC program has been explained, the CSSC program will be described in greater detail. The CSSC main routine controls the calls to 20 different functions. Three of these functions are called upon only at system start up. The remaining functions are contained in an infinite loop that, at 5 minutes past each hour, determines the outputs to the direct digital controller.

The main routine (See HIPO 1.0) is invoked by a startup batch file that runs continuously. The startup batch file ensures that if power fails when no operator is available, the program will return to a steady state. If no measurements are missed, this occurs without delay. This important function is accomplished by writing all "learned variables" to the hard disk of the computer after each cycle.

Three functions in the main routine appear before the infinite loop. These are READ_OP_INPUT, INITSTUFF, and HDREAD. The READ_OP_INPUT (See HIPO 1.1) gathers the user definitions from files that are written from the operator interface, i.e. FIGS. 4–14. These inputs include the rate structure, the utilization factors, the point locations of the energy management system, etc. INITSTUFF (See HIPO 1.2) reads the user contributed initialization file also written from the operator interface. The initialization file contains a typical day's temperature profile, load profile and non-cooling profile. It then initializes all of the program variables to safe states. The HDREAD function (See HIPPO 1.3) reads the "learned variable" values from the hard disk. This includes the covariance matrix, the regressor vector, and the historical temperature and load arrays. The main routine then falls into the continuous loop.

At the head of the main routine's continuous loop, a clock routine (HIPO 1.4) is called. The clock routine makes looped system calls to get the time structure and converts it to hour, minutes and seconds by masking. It is important to note that this is a system dependent routine. It continues making these loop calls and tests for minutes and seconds equal to five and zero respectively. Once this test is true, the clock function gets the month, day, day of the week, and sets the time related indexes before returning to the main routine.

The main routine then invokes XLREAD (HIPO 1.5) to get the current hour's measurements from the energy management system. This routine is extremely dependent upon the communication features of the energy management system.

The main routine again invokes READ_OP_INPUT to read any changes. Such changes could include a new rate structure that may change seasonally. The main routine then calls PERF (HIPO 1.6) to calculate the updated coefficients of performance, i.e. COPDAY, COPNITE. PERF starts with the operator coefficient of performance estimates and updates them using a weighted average. The COP's are determined from the equation: COP=(Chiller-Kw-Out/Chiller-Kw-In) $\times$3.517.

The algorithm is designed so that PERF will not update the coefficients of performance if the chiller-Kw-Out or the Chiller-Kw-In values are small. In such instance, it invokes NON-COOL-LOAD (HIPO 1.7) to update the non-cooling load prediction matrix. This simply uses last week's values to create the predicted values.

The next step is for the main routine to determine the four outputs to the energy management system, i.e. the Direct Digital Controller. These are determined by calling the TEMPEXEC, LOADEXEC, TRADE and PLAN routines. The four outputs are DL (Demand Limit Set Point); CHLW (Chiller-Kw Set Point); MP (Charge/Discharge Mode Setting); and the STORAGE-FILL-LEVEL setpoint. A function called OUTPUTS is then responsible for communicating these four values to the energy management system and writing the "learned values" to the hard disk. The OUTPUTS function is at the end of the main routine's continuous loop. Thus, after completing this cycle, the main routine goes back to the head of the loop and calls the clock function and waits until five minutes past the next hour.

Three sets of algorithms are vital to proper operation of the system to maximize energy cost reductions. These are the temperature prediction algorithms, the cooling load prediction algorithms, and the optimum strategy selection algorithms. These are discussed individually below.

The temperature prediction algorithms are used to determine a 24 hour predicted temperature profile from the projected high and low temperatures input by the user, the actual temperatures from the current and previous cycles, and an array of shape factors. These shape factors refer to the assumption that a daily temperature pattern can be established by each hour's position relative to the high and low temperatures. A weighted average is used so that seasonal adjustments naturally occur.

The temperature prediction calculation of the CSSC system are divided into four functions:

(1) TEMPEXEC (Temperature Prediction Executive);

(2) FSHAPES (Updating of Shape Factors);

(3) THILO (Updating of Projected High and Low Temperatures); and (4) TPREDICT (Temperature Prediction Calculations).

The TEMPEXEC (HIPO 1.8) function is called from the main routine once each hour after data has been collected from the operator and energy management system. The TEMPEXEC function calls the THILO function (HIPO 1.8.2) every hour except the end of peak period. At the end of peak period, it will call FSHAPES (HIPO 1.8.1) instead. The TEMPEXEC function also calls TPREDICT (HIPO 1.8.3) each hour to update the temperature predictions with the updated projected high and low or shape factors before returning to the main routine.

The shape factor profile is updated in five steps by the FSHAPES routine. First, FSHAPES (HIPO 1.8.1) calculates the temperature changes for the previous cycle. More specifically, FSHAPES finds the differences between the high and low temperatures and the end of peak and low temperatures. Second, FSHAPES tests these changes for reasonableness. If they are found to be uncommonly small or large, then the shape factors will not be updated. Third, FSHAPES calculates the current shape factors fn[hr], using the temperatures from the previous cycle and the temperature changes as follows:

$$fn[hr]:=(temp[hr]-low_temp)/delta\ t.$$

Fourth, the FSHAPE routine determines that its shape factor profile is not reasonable if any single factor is too low or too high, or if the differences between any two consecutive factors is too high. If it is unreasonable, then the shape factor profile will not be modified. Finally, the FSHAPES routine calculates the new shape factor profile, fn[hr], from the previous and current profiles using a weighted average as follows:

$$f[hr]:=(0.8\times f[hr])+(0.2\times fn[hr]).$$

After completing the five step process outlined above, the FSHAPES function updates the predicted hour of the occurrence of the high and low temperatures by finding the occurrence from the previous cycle and modifying them if they are within reasonable limits.

Projected highs and lows are updated by the THILO routine (HIPO 1.8.2). The THILO routine starts with an initial predicted high and low from the user and then updates either the projected high or low depending on the hour during the routine is called. Bottom cycle is defined as the time from the end of peak to the time at which the low temperature occurs and top cycle is defined as the remaining hours of the 24 hour cycle. If the THILO function is called during the bottom cycle, then the projected low (TLOW) is updated. If the function is called during the top cycle, then the projected high (THIGH) is updated. The projected low for each hour is calculated as follows:

$$proj_low[hr]:=(temp[hr]-(f[hr]\times temp[end\ of\ peak]))/(1-f[h]).$$

To further improve the accuracy of the predicted low, a monotonical weighted "faith" factor is introduced that puts increasing weight on every new proj_low, where:

$$tlow:=((proj_low[hr]\times W1)+(proj_low[hr+1]\times W2)+(proj_low[hr+2]\times W3+\ldots)/(W1+W2+W3+\ldots).$$

Where $W1=1$, $W2=4$, $W3=9$, and $Wi=(i\times i)$.

Similarly, the projected high is determine by the following equations:

$$proj_hi[hr]:=((temp[hr])-temp[hr\ of\ low])/f[hr])+temp[hr\ of\ low]$$

$$thigh:=((proj_hi[hr]\times W0)+(proj_hi[hr+1\}\times W2)+(proj-hi[h4+2]\times W3)+\ldots)/W1+W2+W3+\ldots).$$

Filtering is done to ensure that THIGH is always greater than the highest temperature reading for the current cycle and that THIGH is greater than TLOW.

Cooling load projections are made using a clockwise recursive regression (CRR) approach. This is a modified form of the auto regressive moving average model. In the CRR approach, the hourly cooling load profile for the next day is predicted using the historical cooling load profile data and the predicted ambient temperature profile for the next day. The prediction is done hour-by-hour using historical cooling load data for a given clock hour and the predicted average temperature for the same clock hour. For example, to predict the cooling load tomorrow at the 11th hour, historical cooling loads and ambient temperatures through the 11th hour are used in conjunction with the predicted ambient temperature for tomorrow's 11th hour.

The modified form of the CRR algorithms are:

$$y^j_k=\psi k^{Tj}_k\theta$$

where:

k=day subscript j=hour superscript $\theta$=parameter vector y=output u=input $$\psi=[1-y^{j}_{k-1}, u^{j}_{k}, u^{j-1}_{k}, u^{j-2}_{k}]$$

$$\hat{\theta}^{T}=[\theta_0, \theta_1\theta_2, \theta_3, \theta_4]$$

The CRR algorithms are used at the end of each day to predict the 24 hour load profile for the next day. Hourly loads are integrated to obtain the total daily load. The model, in this form, is such that the results are insensitive to the type of building or loads for which predictions are desired. The load prediction model also takes into account the pull down after weekend and holiday schedules as well as any other weekly periodic effects in the load.

The load prediction computer algorithms and CSSC software are divided into five functions. LOADEXEC (Executive Load Prediction Function); LOADWTS (Weekly Load Weighting Matrix Module); WRLS (Weighted Recursive Least Squares Fit Routine for the Terms Above); and PREDL (Load Prediction Calculations for the psi and y Terms Above).

Each hour the main routine invokes the LOADEXEC function (HIPO 1.9) after the TEMPEXEC function is invoked. The main purpose of the LOADEXEC function is to prepare for and invoke the three other load prediction routines.

The LOADEXEC function maintains variable sized Y (Loads) and U (Temperatures) related arrays using a push and pop technique such that the first element is the most recent measurement. This is done for the PSI equation. The next section of the code sets up flags to determine whether some, all or none of the WRLS function will be invoked. The first flag indicates whether the physical system is on, and the second flag indicates whether the building is being used to normal, full capacity. If the system is on, then the Y and U terms are calculated by scaling down the related arrays by a fixed scaling factor. The WRLS (HIPO 1.9.1) and the PREDL routine (HIPO 1.9.3) are then called. If the system is not on, PREDL will be called, but WRLS will not be invoked. This will leave the theta factor undisturbed.

Next, LOADWTS (HIPO 1.9.2) will be called by the LOADEXEC function to update the normal weighting factors (WF) and the special weighting factors (SF) once each week if the day is Sunday and the hour is the end of the peak period. If the building is not used at a normal, full capacity, the special factors are used. These factors are used to modify the predicted load by a beta term that is currently "turned off" such that the weighting factors cannot influence the predictions.

When the physical system is operation, the WRLS function (HIPO 1.9.1) is called each hour. If the building is not being used at a normal, full capacity, then only the first section of the code is performed before returning to LOADEXEC. The first section places the Y and U terms into the PSI Matrix. If the building is being used normally, i.e., not a weekly, holiday or partial day, the second section of the code is performed. This part of the code calculates gain vector (XK), the co-variance matrix (P), the regressor vector PSI, and other terms that are used to update the theta values. Only the theta values associated with the hour of invocation are modified. Stated otherwise, all five theta factors will be updated for the current hour only.

Again, each hour that the physical system is in operation, the PREDL (HIPO 1.9.3) is invoked. First, the PSIK matrix is filled in using the U and Y terms. Then YP is calculated as a summation over 5 terms of theta times PSIK for the current day of the week.

As indicated above, the key to cost efficient energy consumption is the development of an optimum operating strategy for the HVAC system. This strategy is developed by the strategy selection algorithms. These computer algorithms are executed to determine a nominal hourly rate of discharge of storage for the next day and, hence, the chiller kw set-point profile. The minimum total storage and the amount of storage required for the cooling cycle are provided by the integral of the nominal discharge rate profile. Further, charge computer algorithms determine the optimum start and stop times for charging storage. To meet the updated load profile for subsequent hours, the strategy computer algorithms are executed to update the nominal chiller set-point profile. If any charging period is left and storage is not full, the computer algorithms will update the charging schedule. If the charging period is over, the strategy computer algorithms update the normal chiller set point profile with the given storage inventory.

The charge/discharge computer algorithms of the CSSC system of the present invention are divided into eight functions. These are: TRADE (Rate Comparator); PLANEXEC (Charge and Discharge Planning Executive); CHARGE-MX (Maximum Charge Calculations); DISCHG-CP (Chiller Priority Discharge Routine); DISCHG-SP (Storage Priority Discharge Routine); CHG-OPT (Optimal Charge SetPoint Routine); CHARGE-MT (Mandatory Charge Calculations); and DEMAND (Demand Mapping From Hours to Periods Routine).

Once each hour after TEMPEXEC (HIPO 1.8), LOADEXEC (HIPO 1.9), and PRIORITY (HIPO 1.10) are called, the main routine invokes TRADE. TRADE (HIPO 1.10) then compares the relative costs of direct cooling versus storage for each rate period (Peak, Semi-Peak, etc.). After this comparison is made, TRADE then selects either a chiller priority or storage priority operation for the rate period starting with the peak period. Total building demand which is maintained constant over the period is taken into consideration in making the chiller or storage computations. Building demand is automatically updated incrementally by the computer algorithms if the available storage is less than the amount required for the period. The chiller and storage priority control computer algorithms are constrained using the storage discharge rate limit and the chiller delivery rate limit.

The PLANEXEC (HIPO P1) function is invoked each hour by both the main and the TRADE routines. PLANEXEC makes calls to all of the charge and discharge routines to establish the setpoints for the energy management system. DEMAND (HIPO P1.1) is first called by PLANEXEC to reflect any updates in the demand limit profile. DEMAND simply maps the demand limits from a period array to an hourly array using the hour/period conversion array (IP).

Next, CHARGE-MX (HIPO P1.2) is used to determine the amount of charge available during the remainder of the current cycle. CHARGE-MX does this by returning the maximum potential charging (CHG-MX) for each period based upon the equation:

chg_mx[period]: =MIN(drl−cln), crl).

This is then summed over all periods to get tmax_chg and added to the current storage inventory level (siw) to get the total available charge remaining in the current cycle (avbl).

Once the CHARGE-MX routine has been completed, DISCHG-CP (HIPO 1.3) is used to determine the total mandatory charge (tchg-mt). The chiller priority discharge profile is calculated using the following equation:

disw[hour]: =MIN((clw[hr]−ctl), drl)

where ctl: =MIN((dl[hr]−cln[hr]), crl.

The DISCHG_CP subroutine then reduces abvl for all disw's. The next step in the program is to determine mandatory charges. Mandatory charges are found from the equation:

$tchg_{13}$ mt: =MIN((scl—siw), chgmin)

where chgmin: =tchg—mt+(storage safety factor×scl).

After the mandatory charge is found, the next step is to call CHARGE-MT (HIPO P1.4) to find the planned charge (chg-pln) for each period. Chg-pl equals the sum of all period-related hourly charging (chgw), defined similarly to chg-mx above. Chp-pl is used to find rem-chg for each period as follows:

rem-chg[period]: =chg-mx[period]−chg-pl[period].

The storage priority discharge routine, DISCHG-SP, (HIPO P1.5) is next called by PLANEXEC to modify the discharging relative to economic trade-offs.

Finally, PLANEXEC calls CHG-OPT (HIPO 1.6) and calculates the planned storage discharge in equivalent kilowatts (stow) and the chiller kwh setpoint array (chlw) before returning to the main routine. While the above verbal description is believed to be sufficient to describe the inter-relationship between the various subroutines used to optimize energy consumption and reduce electrical costs, understanding of this discussion will be enhanced by a review of the flow charts set forth in FIG. 15 and the HIPO diagrams related thereto which have been uniquely numbered for fast correlation. A separate HIPO diagram exists for each subroutine in the software. The HIPOs are designed to accurately represent the various inputs required to run the subroutine, the processing that takes place within the subroutines and the resulting output from the subroutine. It is believed that the HIPOs provide a much clearer picture of the functionality of the present invention than would be found from standard flow charts.

From the foregoing discussion, it should now be readily apparent to those of ordinary skill in the art that the above described system develops a strategy that manages the charging and discharging of ice storage to meet load requirements at minimum costs. This strategy is clearly dependent upon a wide variety of factors which permit energy consumption to be optimized from a low cost standpoint. Further, this system permits the strategy to be updated hourly based upon actual measurements of pertinent parameters. This is important to insure effective management of the overall system.

In order to meet the requirements of the patent laws, the inventors have set forth above what they believe the best mode of their invention. However, it is quite clear that one could modify such a system without deviating from its teaching. For example, one could easily rearrange the order in which certain algorithms are undertaken and still have the system which is equivalent, thus, it must be recognized that the above discussion is merely illustrative and is not intended to be limited.

APPENDIX

A.2 HIPO DIAGRAMS

| | |
|---|---|
| 1.0 | CSSC main |
| 1.1 | read_op_input |
| 1.2 | init |
| 1.3 | hdread |
| 1.4 | clock |
| 1.5 | xlread |
| 1.6 | perf |
| 1.7 | non_cool_load |
| 1.8 | tempexec |
| 1.8.1 | shapes |
| 1.8.2 | thilo |
| 1.8.3 | tpredict |
| 1.9 | loadexec |
| 1.9.1 | wrls |
| 1.9.2 | loadwts |
| 1.9.3 | predl |
| 1.9.4 | load_test |
| 1.9.4.1 | warning_file |
| 1.10 | priority |
| 1.11 | trade |
| 1.12 | outputs |
| 1.12.1 | xlpto |
| 1.12.2 | hdwrite |
| P1 | planexec |
| P1.1 | demand |
| P1.2 | charge_mx |
| P1.3 | dischg_cp |
| P1.4 | charge_mt |
| P1.5 | dischg_sp |
| P1.6 | chg_opt |

C1.0 csscoi
C1.1 rate_structures
C1.2 configuration
C1.3 cycle_definition
C1.4 point_definition
C1.5 system_parameters
C1.6 startup_values
C1.7 exit

| INPUT | PROCESS | OUTPUT |
|---|---|---|
| Operator input files | 1. Get operator input | |
| | 2. Invoke initialization function | |
| Previous hour data log | 3. Read data log for last hour from hard disk | |
| | 4. Invoke clock function to get current time | |
| | If current time is five minutes past any hour, | |
| | then do 5 through 14. | |
| EMS system readings | 5. Get excel sensor data | |
| | 6. Invoke perf function | |
| | 7. Invoke non_cool_pred function | |
| | 8. Invoke temp_prediction function | |
| | 9. Invoke load_prediction function | |
| | 10. Invoke priority function | |
| | 11. Invoke trade-off function | |
| | 12. Invoke plan function | |
| | 13. Send output to excel system | Chiller kW, demand, priority, fill_level |
| | 14. Write data log for current hour to hard disk and return to step 4. | Current hour data log |

NOTES:
This program is invoked by a start-up batch file.

| HIPO NUMBER: | MNEMONIC: | AUTHOR: | OUTSIDE SERVICES REQUIRED: |
|---|---|---|---|
| 1.0 | CSSC | DGT | |
| | | | 1.2 INIT Initialization routine |
| TITLE: | | DATE: | 1.3 HDREAD read log data from last hour |
| CSSC main routine | | 10/10/87 | 1.1 OPIN get operator inputs |
| | | | 1.4 CLOCK perform timing function |
| | | | 1.5 XLREAD get sensor data from excel system |
| | | | 1.6 PERF update coefficients of performance |
| | | | 1.7 NON_COOL_LOAD predict ncl |
| | | | 1.8 PREDT temperature prediction |
| | | | 1.9 LOAD load prediction |
| | | | 1.10 PRIORITY establish chiller/storage priority |
| | | | 1.11 TRADE perform trade-off calculations |
| | | | 1.12 OUTPUTS output to excel system and h. disk |
| | | | P1 PLAN determines charging and storage plans |

| INPUT | PROCESS | OUTPUT |
|---|---|---|
| rate structure file<br>utilization file<br>system config file<br>point definition file<br>system param file | For each file :<br>1. open file<br>2. read all data<br>3. close file | operator input values |

NOTES:

The input data can be modified through the operator interface at any time except while the files are being read (approx. 5 to 7 minutes after each hour).

| HIPO NUMBER: | MNEMONIC: | AUTHOR: | OUTSIDE SERVICES REQUIRED: |
|---|---|---|---|
| 1.1 | OPIN | DGT | NONE |

| TITLE: | DATE: |
|---|---|
| read_op_input | JAN 31, 1988 |

| INPUT | PROCESS | OUTPUT |
|---|---|---|
| initial param file<br>including:<br>temp profile<br>load profile<br>non-cool-load prof | 1. read init parameter file | initialized profile variables |
| storage capacity lim<br>discharge rate limit<br>chiller rate limit | 2. factor scl, drl, and crl with COPs and convert to equivalent kW's | modified scl, drl, crl |
| | 3. initialize algorithm variables | initialized variables |

NOTES:

| HIPO NUMBER: | MNEMONIC: | AUTHOR: | OUTSIDE SERVICES REQUIRED: |
|---|---|---|---|
| 1.2 | INIT | DGT | NONE |

| TITLE: | DATE: |
|---|---|
| initstuff | JAN 31, 1988 |

| INPUT | PROCESS | OUTPUT |
|---|---|---|
| hard disk file | 1. read hard disk file to retrieve all living data from last good cycle | good data from previous uninterupted prediction cycle |

NOTES:

| HIPO NUMBER: | MNEMONIC: | AUTHOR: | OUTSIDE SERVICES REQUIRED: |
|---|---|---|---|
| 1.3 | HDRD | DGT | NONE |

| TITLE: | DATE: |
|---|---|
| hdread | JAN 31, 1988 |

| INPUT | PROCESS | OUTPUT |
|---|---|---|
| BDOS tod structure<br>no. of leap yrs since 1980<br>current leap year flag | 1. convert tod structure to month, day hour, and minute format | month<br>day of month<br>hours (0-23)<br>minutes |

NOTES:
BDOS calls are specific to Concurrent DOS. dateconv is not fully developed.

| HIPO NUMBER: | MNEMONIC: | AUTHOR: | OUTSIDE SERVICES REQUIRED: |
|---|---|---|---|
| 1.4 | CLOCK | DGT | BDOS<br>dateconv |

| TITLE: | DATE: |
|---|---|
| clock | JAN 31, 1988 |

| INPUT | PROCESS | OUTPUT |
|---|---|---|
| building kW<br>chiller kW | 1. initialize NCL matrix with :<br>NCL=building kW - chiller kW | predicted NCL matrix |

NOTES:

| HIPO NUMBER: | MNEMONIC: | AUTHOR: | OUTSIDE SERVICES REQUIRED: |
|---|---|---|---|
| 1.7 | NCL | DGT | |
| TITLE: | DATE: | | |
| non_cool_pred | JAN 31, 1988 | | |

| INPUT | PROCESS | OUTPUT |
|---|---|---|
| current hour | 1. if current hour is end of peak period<br>then invoke tupshape function<br>else, for any other hour, invoke tupdate<br><br>2. invoke tpredict function | |

NOTES:

This is the executive function for temperature prediction. Tupshape will update the shape factors , tupdate will update the predicted high and lows, and tpredict will calculate the predicted temperature array for tomorrow.

| HIPO NUMBER: | MNEMONIC: | AUTHOR: | OUTSIDE SERVICES REQUIRED: |
|---|---|---|---|
| 1.8 | TEMPEXEC | DGT | tupshape |
| | | | tupshape |
| TITLE: | DATE: | | tpredict |
| tempexec | JAN 31, 1988 | | |

| INPUT | PROCESS | OUTPUT |
|---|---|---|
| array of last cycles actual temperatues<br>array of current cyc actual temperatures<br>shape factors<br>hrs of low&high temp<br>hr of end of pk period | 1. calculate temp deltas from hour of low to hr of high and for hour of low to hour of end of peak using ACTUAL temperatures<br>2. perform reasonableness checks on deltas<br>3. if deltas are reasonable, calculate new shape factor, fn[hour], as:<br>fn:=the fraction of delta that the last cycles actual temp deviated from the low temp<br>4. calculate new shape factor, f[hour], as<br>f:=(.8 * f ) + (.2 * fn)<br>5. scan new f's for hours of low and high temps | shape factors f[hour]<br>hr of low & hr of high |

NOTES:

| HIPO NUMBER: | MNEMONIC: | AUTHOR: | OUTSIDE SERVICES REQUIRED: |
|---|---|---|---|
| 1.8.1 | SHAPES | DGT | none |
| TITLE: | DATE: | | |
| shapes | JAN 31, 1988 | | |

| INPUT | PROCESS | OUTPUT |
|---|---|---|
| current hour<br>hrs of low, high, end of peak period<br>current cycle temps<br>operator pred low t<br>shape factors | if curr hr is between end of peak and hr of low, update projected low using relevant and current data<br>if curr hr is between hr of low and hr of high update projected high | projected low temp<br>projected high temp |

NOTES:

| HIPO NUMBER: | MNEMONIC: | AUTHOR: | OUTSIDE SERVICES REQUIRED: |
|---|---|---|---|
| 1.8.2 | THILO | DGT | none |
| TITLE: | DATE: | | |
| thilo | JAN 31, 1988 | | |

| INPUT | PROCESS | OUTPUT |
|---|---|---|
| temp @ end of peak<br>projected low temp<br>projected high temp<br>hr of low temp<br>hr of end of peak<br>shape factor array | 1. calculate temp deltas for PROJECTED low to PROJECTED high and for PROJECTED low to temp @ end of peak<br>2. calculate predicted temp, tp[hour], as tp := pred low + ( f[hour] * delta ). | predicted temp array |

NOTES:

The predicted temperature array, tp[24], is updated for all hours that have not elapsed. Tpredict is invoked once every hour after a new temperature reading has been collected.

| HIPO NUMBER: | MNEMONIC: | AUTHOR: | OUTSIDE SERVICES REQUIRED: |
|---|---|---|---|
| 1.8.3 | TPRED | DGT | none |

| TITLE: | DATE: |
|---|---|
| tpredict | JAN 31, 1988 |

| INPUT | PROCESS | OUTPUT |
|---|---|---|
| curr temp and load<br>cycle and util cef's<br>curr day/time<br><br>scaling factors | 1. Set up load and temp terms<br>2. Set bldg operation and utilization flags<br>3. Invoke wris<br>4. Invoke predl<br>5. Factor yp with pct<br>6. Invoke loadwts | <br><br>updated thetas<br>updated load pred. yp<br>factored yp's<br>wt'ed, factored yp's |

NOTES:

| HIPO NUMBER: | MNEMONIC: | AUTHOR: | OUTSIDE SERVICES REQUIRED: |
|---|---|---|---|
| 1.9 | LOADEXEC | DGT | wris<br>loadwts<br>predl |

| TITLE: | DATE: |
|---|---|
| loadexec | JAN 31, 1988 |

| INPUT | PROCESS | OUTPUT |
|---|---|---|
| load and temp terms | 1. Fill in regressor matrix, psi | |
| | If system is in operation, then | |
| p, w and psi terms | 2. Calc intermed. terms, | |
| | v1, d1, um, den | |
| um, den terms | 3. Calc covariance matrix, p | |
| p, psi, w | 4. Calc the gain vector, xk | |
| psi, thetas | 5. Update p0 term | |
| xk, y, p0 above | 6. Update theta terms for curr hour | theta terms |

NOTES:

| HIPO NUMBER: | MNEMONIC: | AUTHOR: | OUTSIDE SERVICES REQUIRED: |
|---|---|---|---|
| 1.9.1 | WRLS | DGT | NONE |

| TITLE: | DATE: |
|---|---|
| wrls | JAN 31, 1988 |

| INPUT | PROCESS | OUTPUT |
|---|---|---|
| | if day is sunday and hr is end of peak | |
| | then, for each day and each hour, | |
| | if bldg utilization is full | |
| | and if the load[hr] > .2 * desl | |
| | fact := load / pl | |
| | else wf=.2*wf + .8 * fact | |

NOTES:

| HIPO NUMBER: | MNEMONIC: | AUTHOR: | OUTSIDE SERVICES REQUIRED: |
|---|---|---|---|
| 1.9.2 | LOADWTS | DGT | NONE |

| TITLE: | DATE: |
|---|---|
| loadwts | JAN 31, 1988 |

| INPUT | PROCESS | OUTPUT |
|---|---|---|
| load terms<br>temp terms | 1. Calculate adjusted regressor vector, psik | |
| theta terms | 2. Calculate the predicted load profile, yp | predicted load profile, yp |

NOTES:

| HIPO NUMBER: | MNEMONIC: | AUTHOR: | OUTSIDE SERVICES REQUIRED: |
|---|---|---|---|
| 1.9.3 | PREDL | DGT | NONE |

| TITLE: | DATE: |
|---|---|
| predl | JAN 31, 1988 |

| INPUT | PROCESS | OUTPUT |
|---|---|---|
| pred. load array, yp<br>design load, desi<br>avg. loads, avg_coolc<br>actual load, coolc | if yp[hr] > 1.2 * desi OR yp[hr] < 0.05 * desi then<br>1. call warning_file(1) to timestamp occurrance<br>2. if avg_coolc[hr] < 0.1 * desi then update yp as<br>yp[hr] = avg_coolc[hr]<br>3. else, calc yp as<br>yp[hr] = (avg_coolc[hr] / avg_coolc[curr hr])<br>* coolc[curr hr] | new load predict, yp |

| HIPO NUMBER: | MNEMONIC: | AUTHOR: | OUTSIDE SERVICES REQUIRED: |
|---|---|---|---|
| 1.9.4 | LOADTEST | DGT | warning_file() |

| TITLE: | DATE: |
|---|---|
| yp_check | MAY 31, 1988 |

| INPUT | PROCESS | OUTPUT |
|---|---|---|
| warning code<br>date and time | if file cannot be appened or opened, display message<br>else, append c:csscwarnings with<br>warning code, month, day, hour, minute | warning messages |

NOTES: This was intended to be expanded to time stamp any warnings for system debugging. It is currently only used for yp_check errors.

| HIPO NUMBER: | MNEMONIC: | AUTHOR: | OUTSIDE SERVICES REQUIRED: |
|---|---|---|---|
| 1.9.4.1 | WARN | DGT | |

| TITLE: | DATE: |
|---|---|
| warning_file | MAY 31, 1988 |

| INPUT | PROCESS | OUTPUT |
|---|---|---|
| chiller setpoint<br>demand limit<br>mode priority<br>storage_fill_level<br>EMS point addresses | 1. Call xipto to deliver four setpoints to EMS<br><br>2. Call hdwrite to write the "learned variables" to hard disk | |

NOTES:

| HIPO NUMBER: | MNEMONIC: | AUTHOR: | OUTSIDE SERVICES REQUIRED: |
|---|---|---|---|
| 1.12 | OUTPUTS | DGT | xipto<br>hdwrite |

| TITLE: | DATE: |
|---|---|
| outputs | JAN 31, 1988 |

| INPUT | PROCESS | OUTPUT |
|---|---|---|
| | proprietary | |

NOTES:

This is specific to Honeywell's Deltanet/Excel Plus energy management system. Other brand EMS's will employ different communication techniques.

| HIPO NUMBER: | MNEMONIC: | AUTHOR: | OUTSIDE SERVICES REQUIRED: |
|---|---|---|---|
| 1.12.1 | XLPTO | DGT | float_to_ascii<br>cmdpnt<br>xlptin |

| TITLE: | DATE: |
|---|---|
| xlpto | JAN 31, 1988 |

| INPUT | PROCESS | OUTPUT |
|---|---|---|
| current hour<br>avg. cooling load array<br>new load, coolc | If building utilization factor is nearly one, then<br>calc. avg_coolc[hr] := 0.8 * avg_coolc[hr]<br>+ 0.2 * coolc[hr] | new avg_coolc[hr] |

| HIPO NUMBER: | MNEMONIC: | AUTHOR: | OUTSIDE SERVICES REQUIRED: |
|---|---|---|---|
| 1.13 | AVG_LOAD | DGT | |

| TITLE: | DATE: |
|---|---|
| avg_coolc_mod | MAY 31, 1988 |

| INPUT | PROCESS | OUTPUT |
|---|---|---|
| storage cap. limit, sci<br>storage inv. level, stw<br>stor safety factor, ssf<br>pred bld cool load, clw<br>charge profile, chgw<br>max charge, chg_mx | 1. call demand()<br>2. initialize a bunch of variables<br>3. For all periods, call charge_mx() & sum chg_mx<br>4. Calc avbl := tmax_chg + stw<br>5. For all periods while avbl>0, call dischg_cp()<br>6. Calc tchg_mt := tmax_chg - avbl<br>7. if period == ipt, add ssf*sci to mandatory chg<br>8. For all periods, if tchg_mt>0, call charge_mt()<br>then calc rem_chg as max. chg minus planned chg<br>9. For peak and semi-peak, if storage priority or<br>penalties for incomplete storage , call dischg_sp<br>10. Call chg_opt<br>11. Calculate chlw and stow, the chiller and<br>storage setpoints | |

NOTES: This is the charge/discharge planning exectutive. It is called from main() after the tempexec() and loadexec() have generated predictive demand profiles.

| HIPO NUMBER: | MNEMONIC: | AUTHOR: | OUTSIDE SERVICES REQUIRED: |
|---|---|---|---|
| P1 | PLAN | DGT | demand()<br>charge_mx()<br>dischg_cp()<br>charge_mt()<br>dischg_sp()<br>chg_opt() |
| TITLE: planexec | DATE: MAY 31, 1988 | | |

| INPUT | PROCESS | OUTPUT |
|---|---|---|
| current hour<br>storage space<br>parallel/series_flag<br>chiller rate limit<br>demand limit<br>non-cooling load<br>pred building cooling ld | For next hour thru end of cycle,if off-peak, then<br>1. if parallel system or no cooling load for series, calculate chg = MIN((dl - cln) , (crl-clw)<br>2. decrement space available in storage<br>3. calc. chg_mx, the sum of charge rates during off-peak<br>4. if no space available, decrement chg_mx by the unavailable space | max charge, chg_mx |

NOTES: Assumes that charging during the peak and semi-peak following the peak is not allowed.
Assumes that in a series system that simultaneous charging and cooling load is not allowed.
Assumes that for a parallel system that simultaneous charging and cooling load is allowed.

| HIPO NUMBER: | MNEMONIC: | AUTHOR: | OUTSIDE SERVICES REQUIRED: |
|---|---|---|---|
| P1.2 | CHGMX | DGT | |
| TITLE: charge_mx | DATE: MAY 31, 1988 | | |

| INPUT | PROCESS | OUTPUT |
|---|---|---|
| pred bldg cooling load<br>demand limit<br>non-cooling load<br>chiller rate limit<br>discharge rate limit | For each hour from next hour thru end of cycle,<br>if hour is during off-peak and pred bldg load > 0,<br>1. calc ctl := MIN( (dl[hr]-cln[hr] ), crl)<br>2. if (clw[hr] > ctl) then for chiller priority the discharge, disw[hr] := ciw[hr] - ctl<br>3. if pred bldg load is met, disw will be <= 0 and reman will be positive and used elsewhere<br>4. if load is not met, set iok to zero. This will cause will call for the demand limit to be increased elsewhere and dchgcp recalled | storage available, disw<br>dl status flag , iok |

| HIPO NUMBER: | MNEMONIC: | AUTHOR: | OUTSIDE SERVICES REQUIRED: |
|---|---|---|---|
| P1.3 | DCHGCP | DGT | |

| TITLE: | DATE: |
|---|---|
| dischg_cp | MAY 31, 1988 |

| INPUT | PROCESS | OUTPUT |
|---|---|---|
| chg_mx<br>tchg_mt<br>chiller rate limit<br>pred bldg cooling load<br>parallel/series flag<br>demand limit<br>non-cooling load<br>chgw | 1. calc. spc := MIN( chg_mx , tchg_mt)<br>2. For each hour from next hour thru end of cycle,<br>if off-peak hour, then<br>a. if (crl>clw[hr]) and (clw[hr]<=0 or parallel)<br>then chgw[hr]:=MIN((dl-cln),(crl-clw)<br>b. if chgw>0 then decrement spc by chgw<br>c. if spc<=0 then increment chgw by spc and<br>set spc equal to zero<br>d. Incr chg_pl,the period charge plan by chgw[hr]<br>e. Decr tchg_mt, total chg mandatory, by chgw | chg_pl<br>tchg_mt |

| HIPO NUMBER: | MNEMONIC: | AUTHOR: | OUTSIDE SERVICES REQUIRED: |
|---|---|---|---|
| P1.4 | CHGMT | DGT | |

| TITLE: | DATE: |
|---|---|
| charge_mt | MAY 31, 1988 |

| INPUT | PROCESS | OUTPUT |
|---|---|---|
| amount of avail storag<br>pred bldg cooling load<br>discharge rate limit<br>discharge profile, disw<br>pred. bldg load, clw | For each hour from next hour thru end of cycle, if<br>hour is off-peak and clw[hr] is positive and<br>*amount > 0, then<br>1. increase disw[hr] to the drl or clw[hr]<br>2. decrement *amount by the increase in disw | modified disw profile |

NOTES: This routine redistributes the storage not planned by the dischg_cp routine until all of the storage is planned to be used

| HIPO NUMBER: | MNEMONIC: | AUTHOR: | OUTSIDE SERVICES REQUIRED: |
|---|---|---|---|
| P1.5 | DCHGSP | DGT | |

| TITLE: | DATE: |
|---|---|
| dischg_sp | MAY 31, 1988 |

| INPUT | PROCESS | OUTPUT |
|---|---|---|
| tneed<br>parallel/series flag<br>chgw<br>chiller rate limit<br>pred bldg cooling load<br>demand limit<br>non-cooling load | For each hour from next hour thru end of cycle,<br>if hour is off-peak and tneed is positive, then<br>1. if the pred. bldg load < chiller rate limit, and<br>the system is parallel or clw<=0, then calc.<br>chgw:=MIN((dl-cln), (crl-clw))<br>2. Increase chgw[hr] as necessary from tneed<br>3. Decrement tneed by increase in 2. above | new charge profile, chgw |

| HIPO NUMBER: | MNEMONIC: | AUTHOR: | OUTSIDE SERVICES REQUIRED: |
|---|---|---|---|
| P1.6 | CHGOPT | DGT | |

| TITLE: | DATE: |
|---|---|
| chg_opt | MAY 31, 1988 |

What is claimed is:

1. For a building having a HVAC system which includes chiller means, pump means, storage means, heat exchanging means and a chilled water loop between said chiller means, storage means, and heat exchanging means, an operating method for a cool storage supervisory controller for controlling the HVAC system where the controller includes a direct digital controller, a first control interface between said direct digital controller and said chiller means, a second control interface between said direct digital controller and said pump means, a third controller interface between said direct digital controller and said ice storage means, computing means including data input means, data storage means, memory means, display means, and processing means and a two-way data transfer gateway for communication between said computing means and said direct digital controller, the operating method comprising the steps of:

(a) operating the computing means to determine the predicted ambient temperatures from a projected high temperature and projected low temperature input by the user, historical data of actual temperatures from the current and previous cycles stored by the storage means, and an array of shape factors which assume a daily temperature pattern can be established by each hour's position relative to high and low temperatures;

(b) operating the data input means to receive data including predicted building load requirements and power company rate structure information; and (c) determining a new shape factor by operating the computer means to:

(i) calculate temperature charges for the preceding cycle, (ii) test these changes for reasonableness, (iii) if reasonable, calculate current shape factors using the temperatures from the previous cycle and the temperature changes, (iv) determine whether the current shape factors are reasonable, and (v) if reasonable, calculate a new shape factor profile from the previous and current profiles using weighted averages; and (d) operating the direct digital controller to implement a charge/discharge strategy for the storage means where the strategy is a function of the predicted ambient temperatures, the predicted building load requirements and the rate structure information.

2. The method of claim 1 wherein the computer means is operated to calculate new shape factor profile from the previous and current shape factor profiles according to the formula $$f[hr]: =(0.8*f[hr])+(0.2*fn[hr]),$$

where f[hr]: is the new shape factor, fn[hr] is the current shape factor, and f[hr] is the previous shape factor.

3. The method of claim 1 wherein the computing means is operated to predict ambient temperatures determined hourly.

4. The method of claim 1 wherein the computing means is operated to determine building load requirements using a clockwise recursive regression computer algorithm.

5. The method of claim 1 wherein said computing means is operated to determine predicted building load requirements from a cooling load profile and a non-cooling load profile.

6. The method of claim 5 wherein the computing means is operated to determine the cooling load profile from historical cooling load data stored in the storage means and the predicted ambient temperature profile for the next day.

7. The method of claim 6 wherein the computing means is operated to determine cooling load profile as a function of pull down requirements after weekend and holiday schedules as well as any other periodic effects on load.

8. The method of claim 1 wherein said charge/discharge strategy is a function of a comparison of the relative costs of direct cooling verses storage for each rate period.

9. The method of claim 1 wherein the HVAC system includes established set points and the charge/discharge strategy is a function of the established setpoints.

10. The apparatus of claim 1 wherein the charge/discharge strategy depends upon the amount of charge available during the remainder of the current cycle.

11. The method of claim 1 wherein the charge/discharge strategy depends upon the mandatory charge.

12. The method of claim 1 wherein the charge/discharge strategy depends on a plurality of economic tradeoffs.

13. The method of claim 1 wherein the direct digital controlled is operated to control the charge and discharge of storage using the charge/discharge strategy.

* * * * *

UNITED STATES PATENT AND TRADEMARK OFFICE

CERTIFICATE OF CORRECTION

PATENT NO. : 4,916,909

DATED : April 17, 1990

INVENTOR(S) : Anoop Mathur, et al.

It is certified that error appears in the above-identified patent and that said Letters Patent is hereby corrected as shown below:

On the title page

Item [75], Line 4, please delete "Donald Taracks" and replace it with -- Douglas Taracks --.

Signed and Sealed this

Seventeenth Day of December, 1991

*Attest:*

HARRY F. MANBECK, JR.

*Attesting Officer*

*Commissioner of Patents and Trademarks*